US006580204B1

(12) United States Patent
Kim et al.

(10) Patent No.: US 6,580,204 B1
(45) Date of Patent: Jun. 17, 2003

(54) HOOK ASSEMBLY FOR USE IN SHADOW MASK FRAME ASSEMBLY

(75) Inventors: Wan Kim, Yongin (KR); Choong-lak Kim, Daejeon (KR); Gi-young Song, Suwon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 150 days.

(21) Appl. No.: 09/604,924

(22) Filed: Jun. 28, 2000

(30) Foreign Application Priority Data

Jun. 30, 1999 (KR) ..... 99-25809

(51) Int. Cl.[7] ..... H01J 29/07

(52) U.S. Cl. ..... 313/404; 313/405; 313/408; 313/269

(58) Field of Search ..... 313/404, 405–408, 313/269

(56) References Cited

U.S. PATENT DOCUMENTS

| | | | | | |
|---|---|---|---|---|---|
| 3,585,431 | A | * | 6/1971 | Long | 313/286 |
| 3,823,336 | A | * | 7/1974 | Nakamura et al. | 313/292 |
| 4,455,505 | A | * | 6/1984 | Ragland, Jr. | 313/404 |
| 5,672,935 | A | * | 9/1997 | Ito et al. | 313/404 |
| 5,780,962 | A | * | 7/1998 | Fujii et al. | 313/402 |
| 5,910,702 | A | * | 6/1999 | Maehara | 313/402 |

* cited by examiner

*Primary Examiner*—Ashok Patel
*Assistant Examiner*—Sikha Roy
(74) *Attorney, Agent, or Firm*—Lowe Hauptman Gilman & Berner, LLP

(57) ABSTRACT

There is provided a hook assembly attached to a shadow mask frame including a base and a spring with a hole in one end thereof and the other end attached to said base, wherein a middle portion of said base is arched such that the arched portion takes the shape of a tunnel.

13 Claims, 4 Drawing Sheets

HOOK ASSEMBLY FOR USE IN SHADOW MASK FRAME ASSEMBLY

BACKGROUND OF THE INVENTION

1. Field of the Invention

The present invention relates to a hook assembly for use in a shadow mask frame assembly and in particular to a hook assembly that attaches a shadow mask frame to the face panel of a CRT. The present invention also relates to a shadow mask frame assembly with such a hook assembly.

2. Description of the Related Art

A shadow mask frame assembly for use in flat CRT comprises a pair of support bars 11,12, a pair of tension bars 13 and 14 of which ends are welded to an each end of the support bars 11 and 12, a shadow mask 20 supported by the support bars 11 and 12 and a plurality of hook assembly 9 attached to the support bars 11 and 12 and/or the tension bars 13 and 14, as shown in FIG. 1. Also, as shown in a circle indicated by "A", there are provided with plurality of slots 22 between strips 21 connected with tie bars 23.

The shadow mask frame assembly is installed in the face panel of the flat CRT by means of the hook assembly 9. More specifically, it is installed in the face panel by inserting stud (not-shown) formed on the inner surface of the skirt portion of the face panel into the hole 28 of the hook assembly 9, comprising base 26 and a spring 27, welded on the support bars 11 and 12 and the tension bars 13 and 14 of a shadow mask frame, as illustrated in FIG. 1.

FIG. 2 is an exploded view of the hook assembly 9 further showing welding points. The hook assembly is firmly attached to the support bars11 and 12 and/or the tension bars 13 and 14 of a mask frame by spot welding at a couple of points 29, i.e., on the part of the base 26. Welding must be very strong because the metallic mask frame is rather heavy. The more so recently since flat panel CRTs use relatively heavier frames. The base 26 of the hook assembly 9 welded on the bars is thick and may suffer heat-induced deformation. For instance, while hook assembly is being welded at one spot it may deform so that the next welding point can be off its spot. The deformed hook assembly results in welding weaker than desired and can cause the mask to shift from intended position.

SUMMARY OF THE INVENTION

It is an objective of the present invention to provide a hook assembly that is less deformable subjected to heat such that the hook assembly can be attached by welding to the predetermined location of the mask frame without error.

The objective is achieved by proving a buffer zone in the middle of a base of the hook assembly in a variety of ways so that possible deformation of the hook assembly at one part during welding can prevented from spreading to the rest of the hook. The buffer zone may be tunnel like arch or indention.

BRIEF DESCRIPTION OF THE DRAWINGS

The above objective and advantages of the present invention will become more apparent by describing in detail preferred embodiments thereof with reference to the attached drawings in which.

DESCRIPTION OF THE PREFERRED EMBODIMENTS

Figure 1:
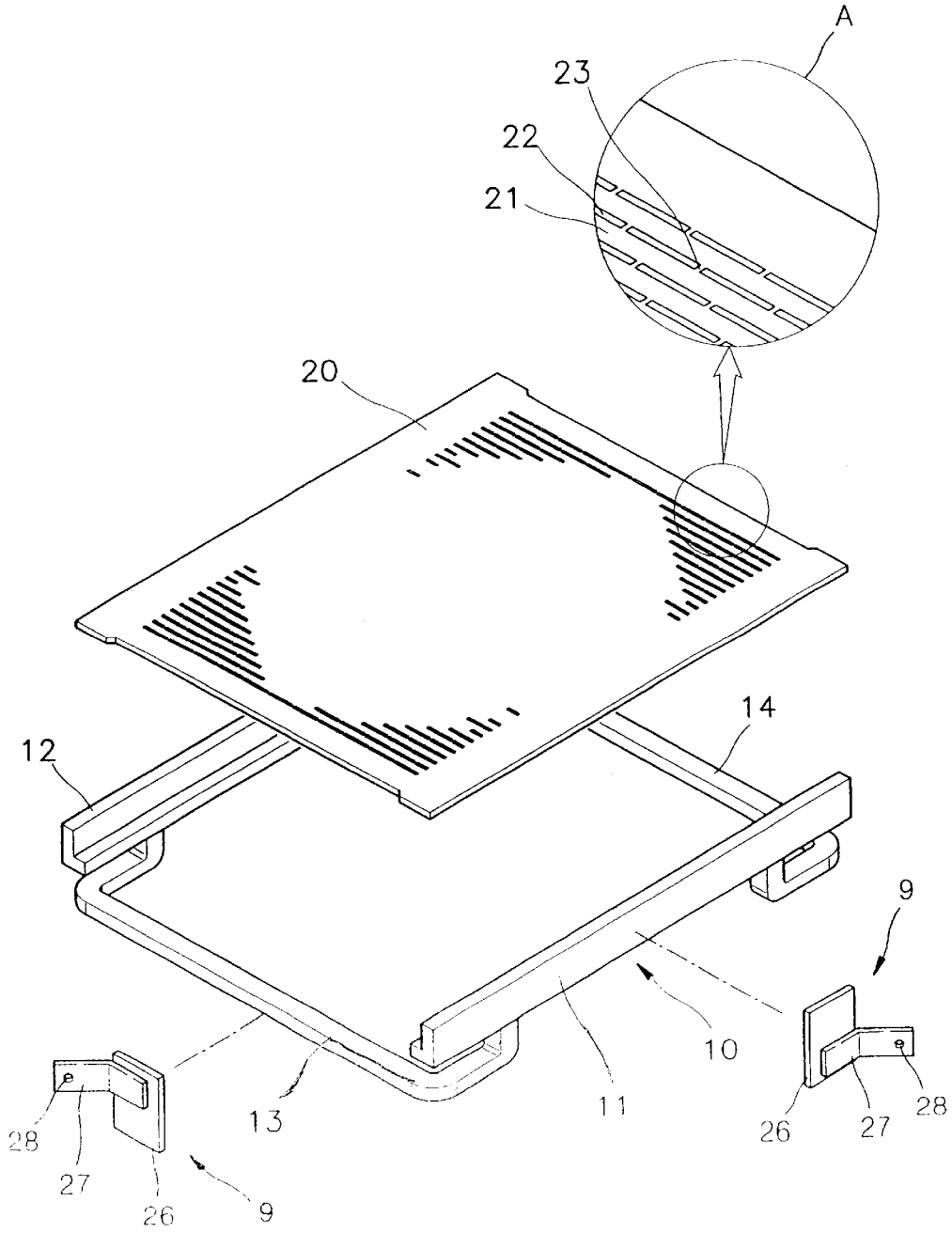
FIG. 1 (PRIOR ART)
FIG. 1 is an exploded view of a shadow mask frame assembly.
Figure 2:
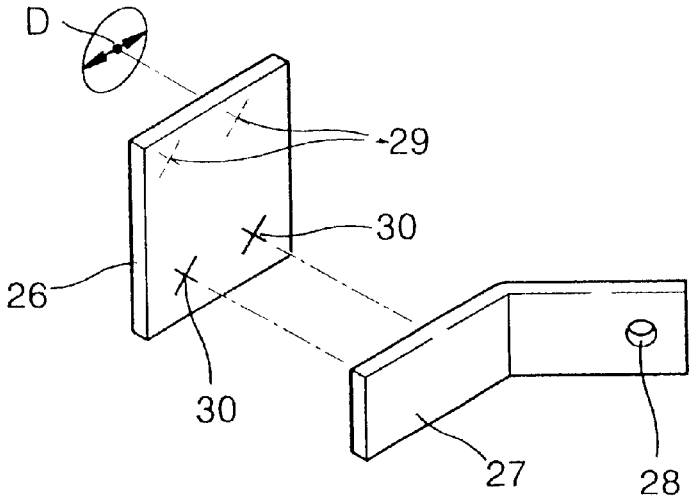
FIG. 2 (PRIOR ART)
FIG. 2 shows a conventional hook assembly welded on a mask frame.

Embodiments of the present invention will be described in detail. First referring to FIG. 3, the base 31 of a hook assembly to be welded to the support bars and/or tension bars of a mask frame has tunnel-like arch portion 32 in the middle of the base 31 and a flat portion 35 on either side of the base 31. The spring 33 having a hole 34 in one end is welded at a point 37 in the lower part of one flat portion of the base 31.

Welding points of the base 31 to the support bars and/or the tension bars are indicated by reference numeral 39. Welding is performed at two points, for an instance, in sequence. With the present invention, while welding is performed at one point, possible heat-induced deformation around the point does not spread to a part of the base 31 where a second welding is to be performed next since the arch portion 32 function as a zone absorbing most of the deformation.

Figure 3:
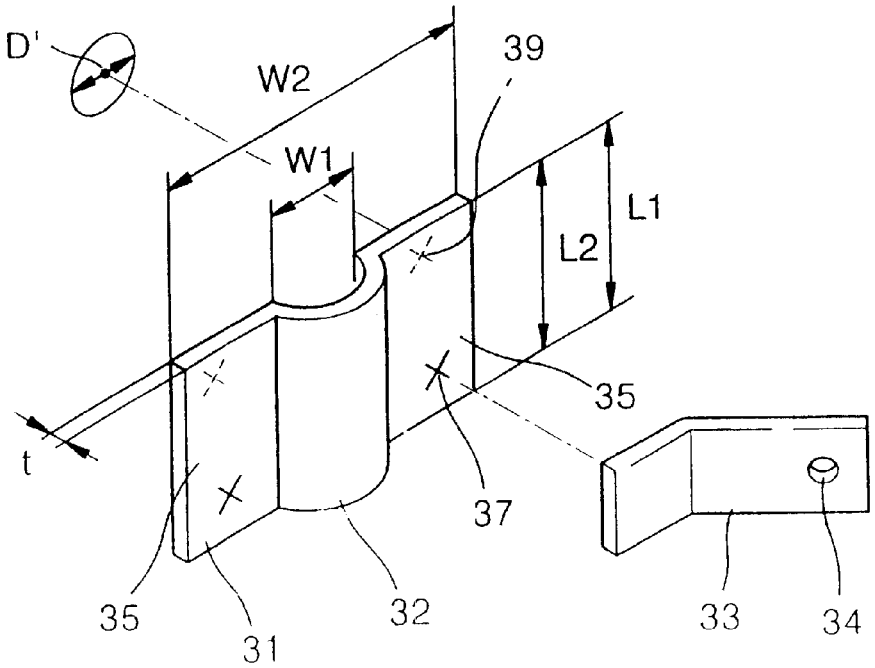
FIG. 3 shows a hook assembly according to a first embodiment of the present invention.

The base 31 of a hook assembly according to the present invention shown in FIG. 3 has a length L2 and widthW2 and its arch portion 32 has a length L1 and a width W1. The thickness of the base 31 represented by t. These dimensions should be determined in accordance with the size of the welding spots at points 39. The welding spots are an area of the hook assembly at which spot welding is perform in order to couple the hook assembly to a mask frame assembly. Let the diameter of average welding spots, which substantially round, be D'. Then it is preferred that L2 is greater than D' (L2>D'), while L2 is equal to or greater than L1 (L2≧L1). Further the width W1 of the arch portion should be greater than the thickness t of the base 31 and yet should be less than a value which is obtained by subtracting the twice the welding spot diameter D' from the whole base width W2. The relation can be represented by an in equation t<W1 <W2−2D'.

The spring 33 is shown welded to the base 31 at one point 37. However, it could have more than one welding point and further the part of a spring that contacts the base 31 may be longer than the width of the base 31. Also, the spring 33 may have an tunnel-like arch portion of its own to closely overlap the arch portion 32 of the base 31. In other words, the surface of the spring arch would match the outer surface of the base arch.

Figure 4:
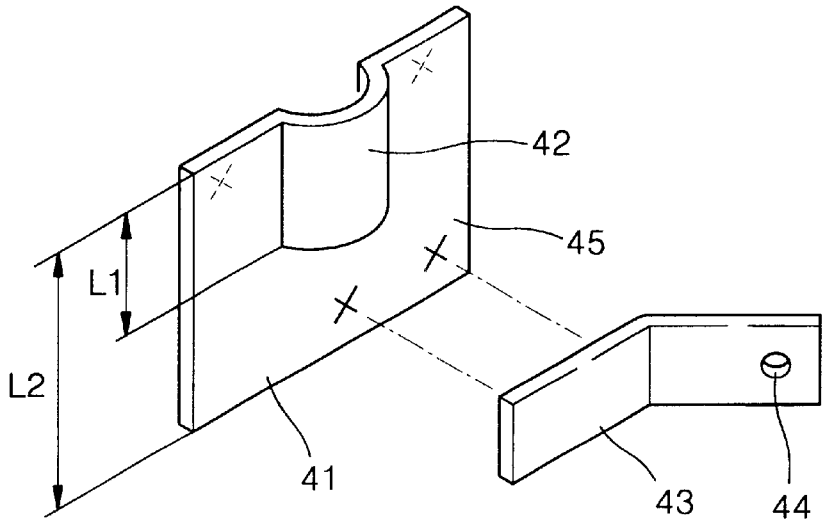
FIG. 4 shows a hook assembly according to a second embodiment of the present invention.

FIG. 4 shows a second embodiment of the present invention. Here the length L1 of the arch portion 42 is less than the whole length L2 of the base 41 while the spring 43 formed with a hole 44 is to be attached flat portion 45 of the base 41 under the arch portion 42.

Figure 5:
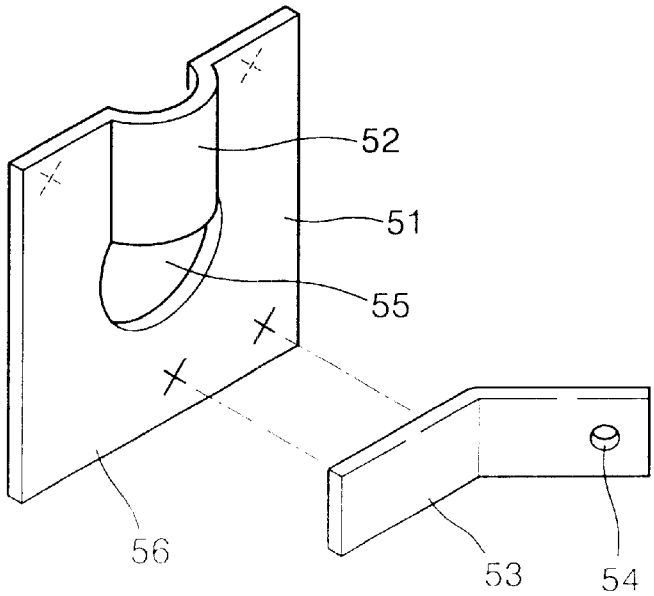
FIG. 5 shows a hook assembly according to a third embodiment of the present invention.

FIG. 5 shows a third embodiment in accordance with the present invention. It is similar to shown in FIG. 4 in that a tunnel-like arch portion 52 is joined by a flat portion 56 but has a hole 55 under the arch portion 52. The hole 55 is located about in the centre of the hook base 51. The hole 55 servers a function of distributing stress during the welding of the base 51 at one point, thereby pr deformation of the hook.

A spring 53 formed with a hole 54 is welded to the flat portion 56 of the base 51.

Figure 6:
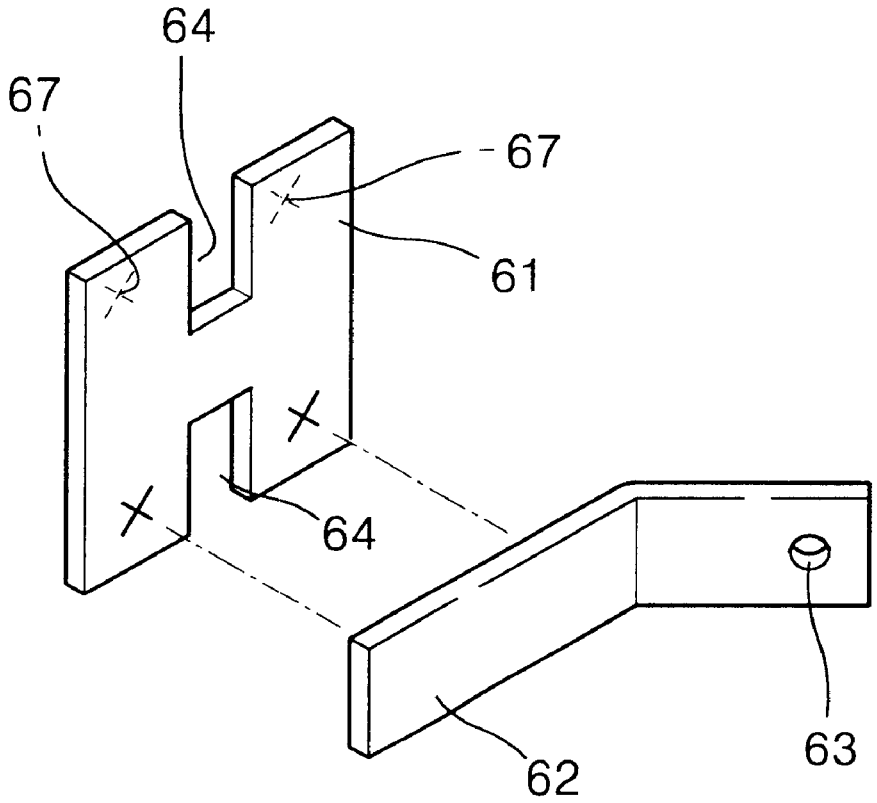
FIG. 6 shows a hook assembly according to a fourth embodiment of the present invention.

FIG. 6 shows a fourth embodiment according to the present invention.

An indention 64 is made on the top and bottom sides of the base 61 such that the base 61 would look like the letter H. A spring 62 with a hole 63 in one end is attached to the base 61 across the lower indention 64. Due to the gap between one welding point 67 and another welding point 67 the stress the base 61 suffers when it is welded to the support bars and/or the tension bars at one welding point can spread to the rest of the hook base, particularly to around the next welding area.

What is claimed is:

1. A hook assembly adapted to be attached to a shadow mask frame of a cathode ray tube, said hook assembly comprising:

a base; and a spring with a hole in one end thereof and the other end attached to said base, wherein a middle portion of said base is arched such that the arched middle portion takes the shape of a tunnel;

wherein an entire length of the base is greater than a length of the arched middle portion.

2. The hook assembly as claimed in claim 1, wherein said length of the base is greater than a diameter of welding spots at which said hook assembly is attached to said shadow mask frame.

3. A hook assembly adapted to be attached to a shadow mask frame of a cathode ray tube, said hook assembly comprising:

a base; and a spring with a hole in one end thereof and the other end attached to said base, wherein a middle portion of said base is arched such that the arched middle portion takes the shape of a tunnel;

wherein a width of the arched middle portion is greater than a thickness of the base and less than the difference between a width of the base and twice a diameter of welding spots at which said hook assembly is attached to said shadow mask frame.

4. The hook assembly as claimed in claim 1, wherein said tunnel extends from an edge of said base towards an opposite edge of said base, said base further comprises a through hole contiguous to said tunnel and disposed between said tunnel and said opposite edge.

5. A hook assembly adapted to be attached to a shadow mask frame of a cathode ray tube, said hook assembly comprising:

a hook base; and a spring with a hole in one end thereof and the other end attached to said hook base, wherein said hook base is generally H-shaped with indentions at two opposite sides thereof.

6. A shadow mask frame assembly for use in a CRT, said shadow mask frame assembly comprising:

a frame comprising a pair of support bars and a pair of tension bars, each of said tension bar having opposite end portions attached to the support bars;

a shadow mask supported by the support bars; and a plurality of hook members each attached to one of the support bars and the tension bars, wherein each of said hook members includes a hook base and a spring with a hole in one end thereof and the other end attached to said hook base, wherein the hook base is generally H-shaped with indentions at two opposite sides thereof.

7. The hook assembly of claim 5, wherein the other end of said spring is attached to said hook base at two attaching points physically spaced by one of said indentations so that said spring spans over said indentation.

8. The hook assembly of claim 7, wherein said spring comprises two portions angled with respect to each other, one of said portions being attached to said hook base at said attaching points while the other being formed with said hole.

9. The shadow mask frame assembly of claim 6, wherein the other end of said spring is attached to said hook base at two attaching points physically spaced by one of said indentations so that said spring spans over said indentation.

10. The shadow mask frame assembly of claim 9, wherein said spring comprises two portions angled with respect to each other, one of said portions being attached to said hook base at said attaching points while the other being formed with said hole.

11. A shadow mask frame assembly for use in a CRT, said shadow mask frame assembly comprising:

a frame comprising a pair of support bars and a pair of tension bars, each of said tension bar having opposite end portions attached to the support bars;

a shadow mask supported by the support bars; and a plurality of hook members each attached to one of the support bars and the tension bars, wherein each of said hook members includes a base and a spring with a hole in one end thereof and the other end attached to said base, wherein a middle portion of said base is arched such that the arched middle portion takes the shape of a tunnel;

wherein an entire length of the base is greater than a length of the arched middle portion.

12. A shadow mask frame assembly for use in a CRT, said shadow mask frame assembly comprising:

a frame comprising a pair of support bars and a pair of tension bars, each of said tension bar having opposite end portions attached to the support bars;

a shadow mask supported by the support bars; and a plurality of hook members each attached to one of the support bars and the tension bars, wherein each of said hook members includes a base and a spring with a hole in one end thereof and the other end attached to said base, wherein a middle portion of said base is arched such that the arched middle portion takes the shape of a tunnel;

wherein a width of the arched middle portion is greater than a thickness of the base and less than the difference between a width of the base and twice a diameter of welding spots at which said hook assembly is attached to said shadow mask frame.

13. The shadow mask frame assembly as claimed in claim 11, wherein said tunnel extends from an edge of said base towards an opposite edge of said base, said base further comprises a through hole contiguous to said tunnel and disposed between said tunnel and said opposite edge.

* * * * *